United States Patent [19]

Hauger et al.

[11] Patent Number: 4,676,680

[45] Date of Patent: Jun. 30, 1987

[54] PRINTING ASSEMBLY WITH COLORING SYSTEM

[75] Inventors: Josef Hauger; Klaus Tauchert, both of Villingen-Schwenningen, Fed. Rep. of Germany

[73] Assignee: Kienzle Apparate GmbH, Villingen-Schwenningen, Fed. Rep. of Germany

[21] Appl. No.: 841,015

[22] Filed: Mar. 17, 1986

Related U.S. Application Data

[63] Continuation of Ser. No. 645,805, Aug. 29, 1984, abandoned.

[30] Foreign Application Priority Data

Aug. 31, 1983 [DE] Fed. Rep. of Germany ... 8325015[U]
Jun. 6, 1984 [DE] Fed. Rep. of Germany ..... 3421033

[51] Int. Cl.[4] ..... D41J 35/04

[52] U.S. Cl. ..... 400/211; 400/120; 400/248

[58] Field of Search ..... 400/240.4, 211

[56] References Cited

U.S. PATENT DOCUMENTS

| | | | |
|---|---|---|---|
| 4,387,380 | 6/1983 | Asakura et al. | 400/120 |
| 4,407,595 | 10/1983 | Gershnow | 400/240.4 |
| 4,410,291 | 10/1983 | Speraggi | 400/247 |
| 4,492,484 | 1/1985 | Akazawa et al. | 400/248 |

FOREIGN PATENT DOCUMENTS

| | | | |
|---|---|---|---|
| 98384 | 6/1982 | Japan | 400/211 |
| 58-39480 | 3/1983 | Japan | 400/247 |
| 58-63494 | 4/1983 | Japan | 400/208 |
| 58-55257 | 4/1983 | Japan | 400/208 |

OTHER PUBLICATIONS

Applegate, Electrothermal Ribbon Path, Oct. 1980, vol. 23, No. 5.

Krautwald, Rapidly Exchangeable Wear-Resistant Plastic Foil in Printers for Separating the Record Carrier from the Ink Cloth, Apr. 1982, vol. 24, No. 11B, p. 6103.

Goff, Cardholder-Ribbon Guide Combination for Printers, May 1979, vol. 21, No. 12, pp. 4744–4746.

*Primary Examiner*—William Pieprz

*Attorney, Agent, or Firm*—Toren, McGeady & Associates

[57] ABSTRACT

A printing apparatus having a printing base with a printing head located to perform a printing operation along said printed base operating with a color transfer band and a recording medium and with a scraper device separating the color transfer band and the recording medium. The printing head swivels between a work position and an insertion position at which the color transfer band and the recording carrier are inserted into the apparatus and the scraper device is supported in the vicinity of the printing base so that it will retain a position between the color transfer band and the printing carrier when the print head is swiveled into the insertion position so that during insertion of the color transfer band and the printing carrier, the scraper means is retained therebetween while the print head is supported on the color transfer band and the printing base during swiveling into the work position.

7 Claims, 8 Drawing Figures

FIG. 3
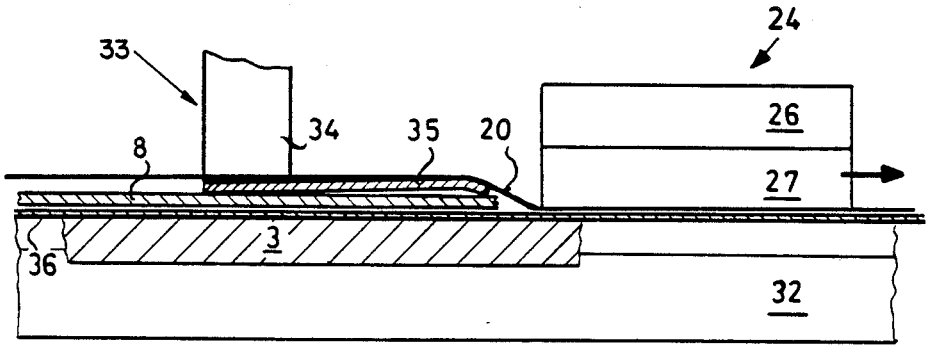
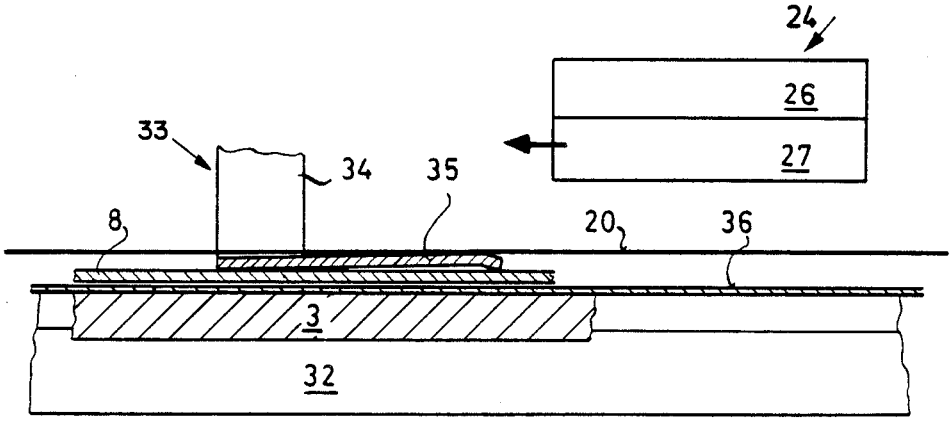
FIG. 3A

PRINTING ASSEMBLY WITH COLORING SYSTEM

This is a continuation of application Ser. No. 645,805 filed Aug. 29, 1984, now abandoned.

The present invention relates generally to printing apparatus having coloring capability and more specifically to a printer wherein the printing is effected by means of a color transfer band or ribbon upon a conventional recording carrier or medium and wherein a scraper or stripper device is connected with the printing head, the scraper device operating to detach or separate the color transfer band from the recording carrier.

In such printing apparatus, there are utilized color bands which are normally suitable only for a single printing operation by means of a color transfer effect. Color bands of this type which are particularly suitable for thermoprinters have the peculiarity that they tend to cling or adhere to the recording material. In order to be able to transport the recording material and the color transfer band separately from each other, for example, in two different directions, it becomes necessary to separate the color transfer band from the recording carrier directly after a printing operation.

In this connection, it is known in the prior art from IBM Technical Disclosure Bulletin, Volume 23, No. 5 of October 1980 to arrange a scraper device in the vicinity of the print head with the scraper device operating to effect separation of the recording carrier and the thermocolor transfer band.

In the known arrangement, a guide roller and the scraper are securely connected with the print head carriage or sled and it becomes possible thereby to move the scraper from the work position into a paper inserting position when the color band is to be transported and/or when the recording carrier is to be moved. However, difficulties arise in such apparatus due to the fact that during introduction of the color band, the color band must be guided around the contact pressure roller, the scraper and the recording head through a zigzag path. It is therefore impossible in such a case to insert the color band without requiring manual operations by a user.

Accordingly, the present invention is directed toward providing a mechanism of the type described wherein the print head and the scraper are arranged relative to each other in such a way that it becomes possible to insert the color band in a paper insertion position of the print head without requiring a manual threading process.

SUMMARY OF THE INVENTION

Briefly, the present invention may be described as printing apparatus including coloring system comprising: means defining a printing base; printing head means located to perform a printing operation along said printing base; means for moving a color transfer band and a recording carrier along said printing base for effecting printing upon said recording carrier by said printing head means; scraper means for separating said color transfer band and said recording carrier; and means for swiveling said printing head means between a work position at which printing operation is performed and an insertion position at which insertion of said color transfer band and said recording carrier into said apparatus may be performed; said scraper means being supported in the vicinity of said printing base in such a way that it retains a position between said color transfer band and said printing carrier when said printing head means is swiveled into said insertion position so that during insertion of said color transfer band and said printing carrier said scraper means is retained therebetween while said printing head means is supported on said color transfer band and said printing base during swiveling into said work position.

Thus, the present invention is particularly characterized in that the print head is arranged to be swiveled between a defined work position and a defined paper insertion position, i.e., a position permitting insertion of the color band and the recording carrier which may be a paper medium, and in that the scraper is constructed as an element supported at stationary parts in the vicinity of the print base in such a way that the scraper will retain its functioning position when the print head swivels into the paper insertion position so that when the paper is inserted the scraper will be held in position between the recording carrier and the color band, while the print head is supported on the color band and the printing base when swiveled into the work position.

In accordance with other aspects of the invention, the color transfer band is arranged in a cartridge or cassette and runs through a printing zone defined in said cassette while it is in a tensioned condition. The arrangement in accordance with the invention makes it possible to insert the color band in a cartridge in the printer without requiring the user to thread the color band around the print head and around the scraper.

The arrangement of the invention functions most securely when the scraper is supported at a stationary part directly in front of the printing base. The scraper is particularly effective when it is itself a resilient or elastic part. If the printing is to be effected in two directions, that is, from left to right and from right to left, then it is preferable to provide two scrapers together with the print head, with one of the scrapers acting when the print head operates to the right and the other scraper acting when the print head operates to the left.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DESCRIPTION OF THE DRAWINGS

In the drawings:

FIGS. 3 and 3A are detailed sectional views showing on an enlarged scale two functioning positions of parts of the apparatus;

DETAILED DESCRIPTION OF THE PREFERRED EMBODIMENTS

Figure 1:
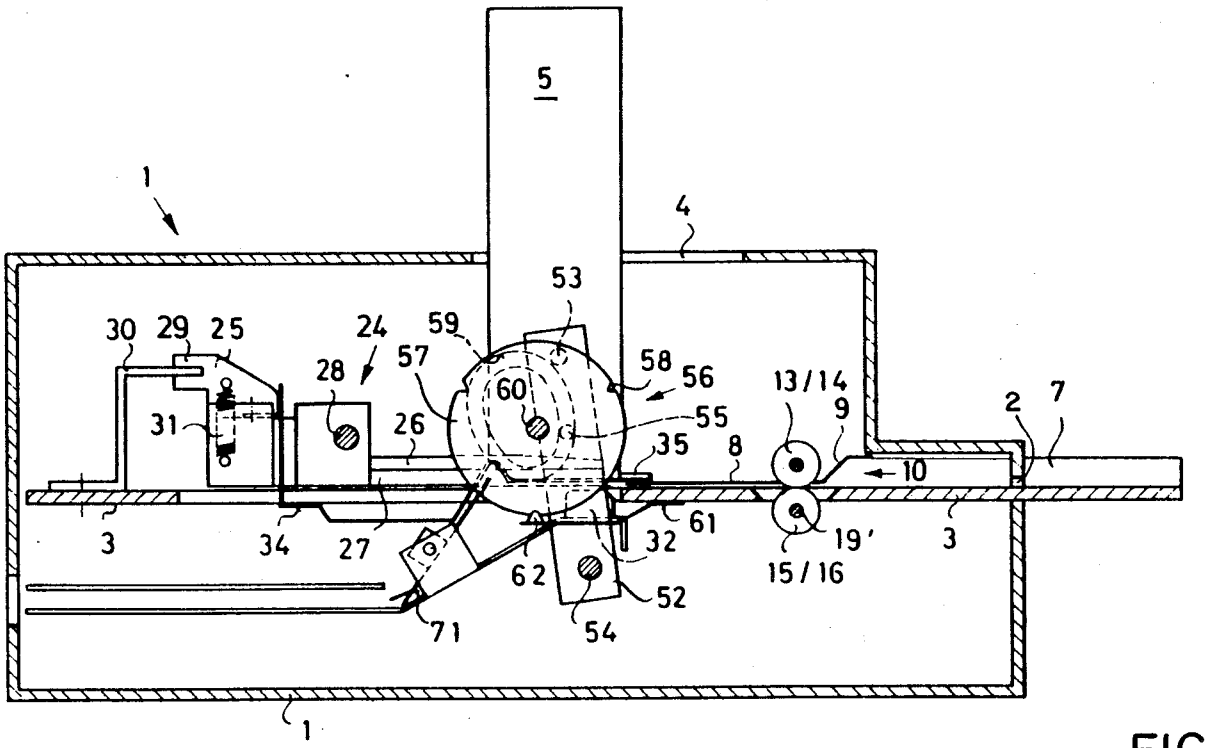
FIG. 1 is a sectional side representation of parts of the mechanism in accordance with the invention.
Figure 2:
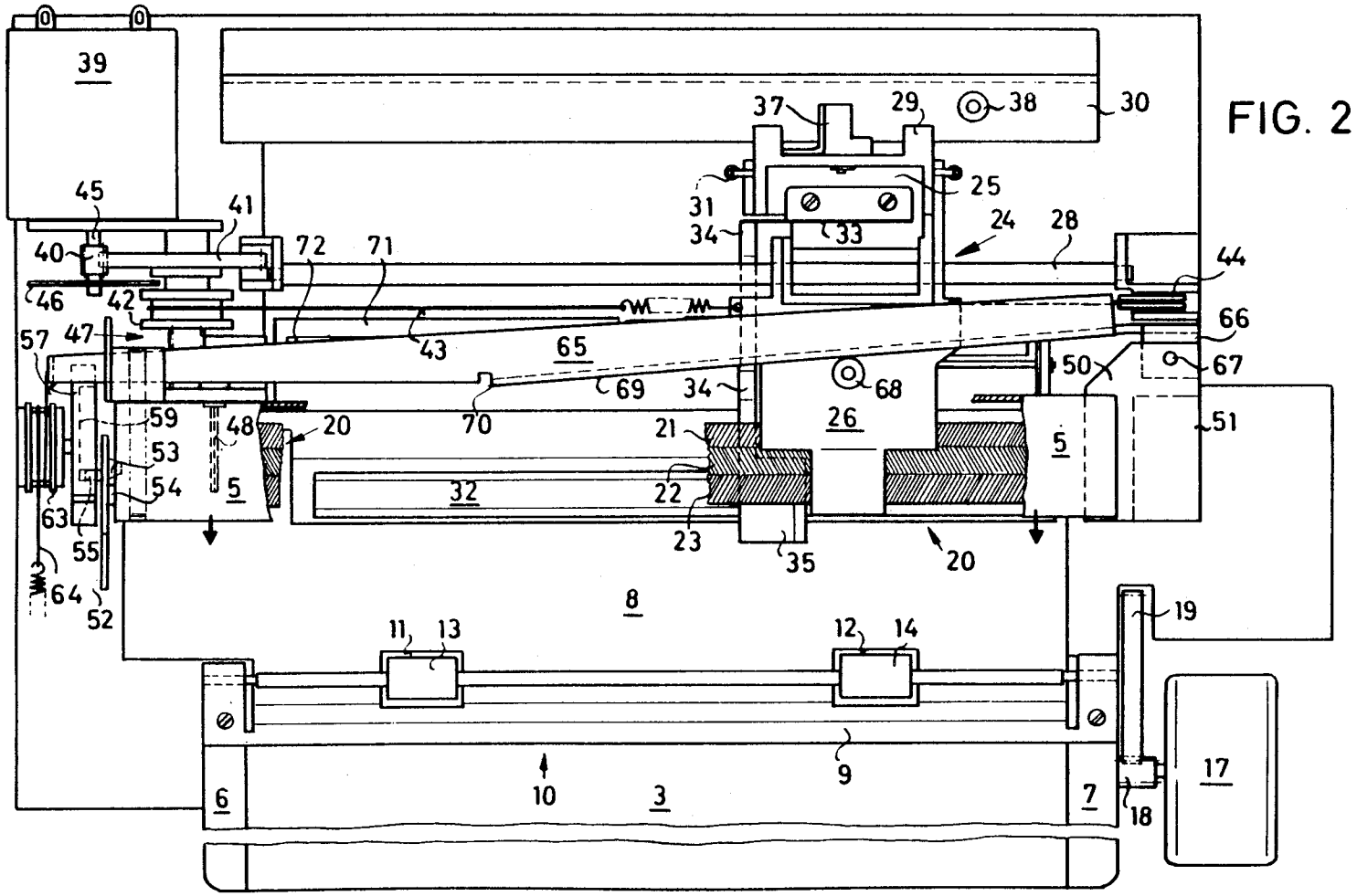
FIG. 2 is a top view showing the arrangement of the invention with the housing cover of the apparatus removed.

Referring now to the drawings and more particularly to FIGS. 1 and 2, the printing apparatus in accordance with the present invention is shown as being accommodated with a housing 1 which encloses the printing arrangement on all sides. The apparatus includes a guide table 3 with an opening 2 being provided at the front of the housing 1 to permit insertion of a recording carrier 36 passing through the opening 2 onto the guide table 3, as shown in greater detail in FIGS. 3 and 3A.

Figure 5:
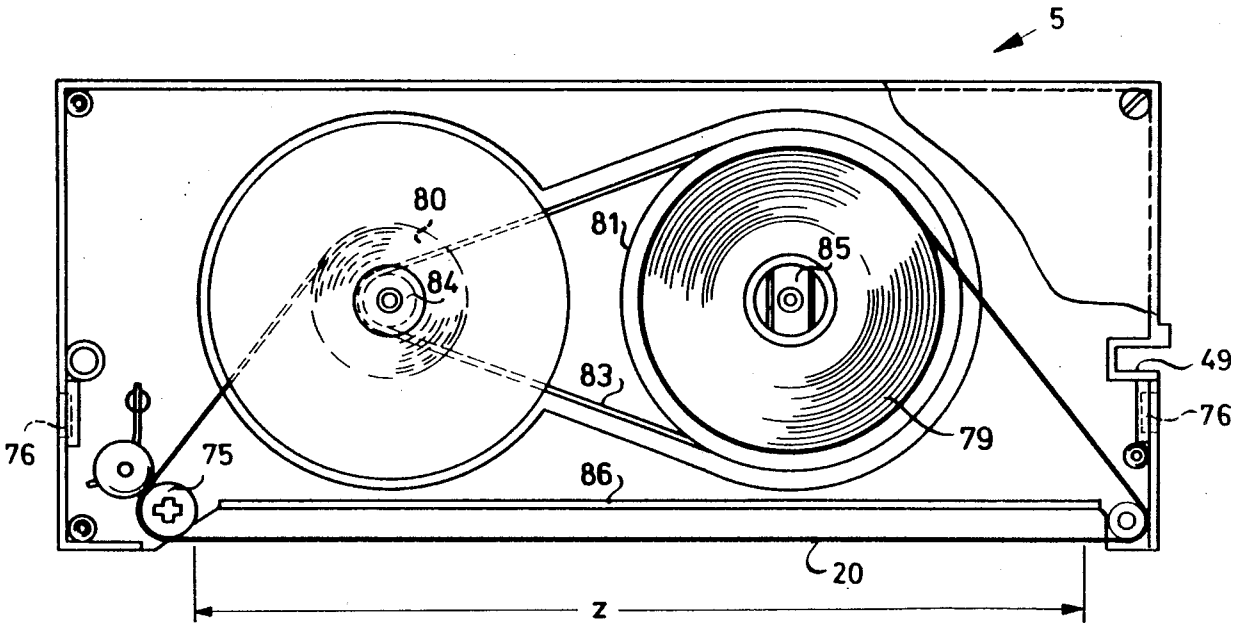
FIG. 5 is a top view of the color band cartridge.

The housing 1 is provided at its upper side with a slot 4 within which a cartridge 5 may be inserted. The cartridge 5 carries a color transfer band 20, as best seen in FIG. 5, and the cartridge 5 is shown in its inserted position in FIGS. 1 and 2. As seen in FIG. 2, the guide table 3 is provided with two lateral guide edges 6 and 7. An upper guide member 8 which is made of sheet metal is formed with a bent portion 9 at its front end so that there is defined an insertion channel 10 through which the recording carrier 36 is inserted.

Recesses 11 and 12 are formed in the upper guide member 8, which may be a sheet metal member, and contact pressure rollers 13 and 14 extend through the recesses 11 and 12 and cooperate with drive rollers 15 and 16 arranged in the guide table 3. The drive rollers 15 and 16 are driven by a motor 17 by means of a gear 18 and another gear 19. The gear 19 drives a shaft 19' upon which drive rollers 15 and 16 are fastened. The motor 17 may be driven in two directions so that it may move the recording carrier 36 in an insertion position or direction as well as in exiting or removal direction.

FIG. 2 also shows the color band 20 which is provided as a thermocolor band having three color zones 21, 22 and 23 which represent the colors yellow, magenta and cyan.

Figure 4:
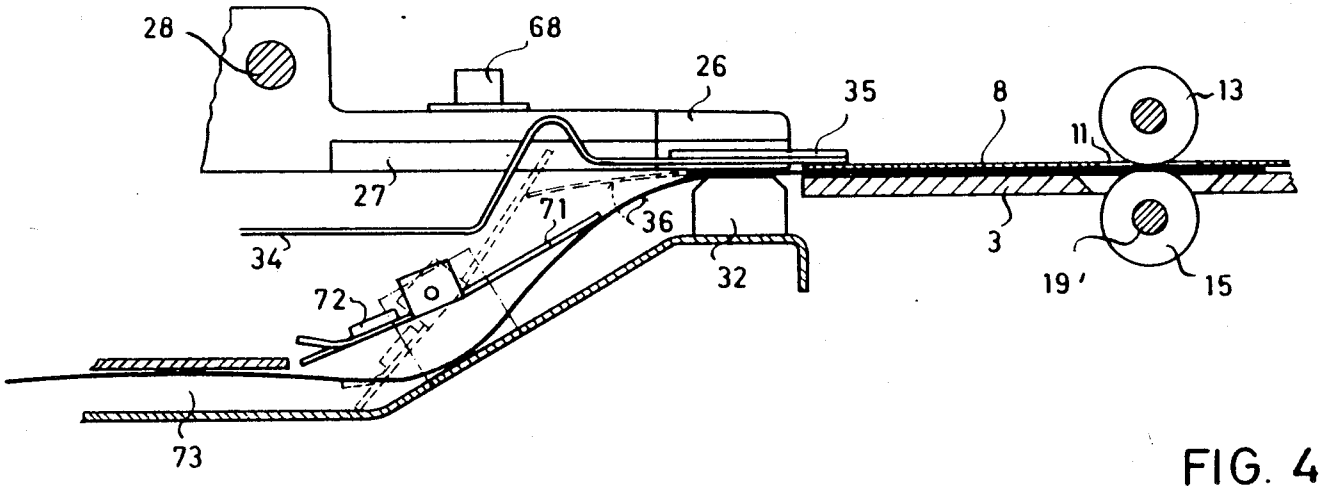
FIG. 4 is a detailed sectional view of the paper guide.

The apparatus is provided with a print head 24 which includes a carrying member 25 and a carrying member 26 with a thermohead 27 including thermoprinting elements, as best seen in FIGS. 1, 3 and 4. The carrying member 25 of the print head 24 is guided for displacement in the horizontal direction on an axle 28 and is at the same time guided at a shoulder or projection 30 by means of projections 29. Accordingly, the member 25 is movable only transversely, but is not adapted to undergo swiveling motion. By contrast, the member 26 is only guided on the axle 28 and may therefore be swiveled in the clockwise direction as seen in FIG. 1 by means of springs 31 which are suspended at both sides in such a manner that the thermohead 27 is supported on a printing beam 32 when it is moved in a printing run from left to right.

Scraper means in the form of a resilient scraper 33 is fastened between the parts 25 and 26 of the print head 24 and the scraper 33 has a multiply resilient bent projection or nose 34 and is supported with its front end 35 on the guide member 8. Furthermore, as will be seen particularly from FIG. 3, the scraper 33 to 35 is supported between the color band 20 and the recording carrier 36.

It should be noted here that the scraper means 33, 34 and 35 is arranged as a spring stirrup in such a way that it constantly, resiliently contacts the upper paper guide 8 regardless of whether the print head 24 is in its printing position, i.e., a work position, or in its raised position, i.e., a paper insertion position. A comparison of FIGS. 3 and 3A will show that in the work position which is depicted in FIG. 3 the thermohead 27 is pressed tightly against the color band 20 and the recording carrier 36 while the scraper means 33 to 35 immediately thereafter separates the color band 20 and the recording carrier 36. On the other hand, in FIG. 3A, it is shown that when the print head 24 is swiveled to the paper inserting position, it is raised sufficiently high so that the color band 20 in its cartridge 5 can be introduced without difficulty between the print head 24 and the scraper means 33 to 35 which is resiliently supported at the printing beam 32 on the guide member 8.

Swiveling movement of the print head 24, and particularly of the part 26, with the part 27 securely connected therewith, relative to the part 25, against the force of springs 31 occurs in that a swivel lever 37 is supported at the rear side of the part 25. The swivel lever 37 cooperates with a stop bolt 38 in its one rightmost end position wherein the stop bolt 38 swivels the swivel lever 37. The part 26 is thereby also swiveled relative to the part 25 and the two parts 26 and 27 are accordingly raised. In contrast, when the print head is in its leftmost position, the swivel lever 37 cooperates with a trip latch or releasing pawl (not shown) which swivels it into its other end position thereby bringing the print head into the printing or work position shown in FIGS. 1, 3 and 4.

The drive of the print head 24 in the line or horizontal direction, as well as the drive of the color band 20 and the displacement of the color band cartridge 5, are accomplished by means of a second motor 39 which drives a pulley 42 through two gears 40 and 41 with a drive belt 43 being tensioned on the roller 42. On the other side, the drive belt 43 is wound about a roller 44. The two ends of the belt are resiliently suspended at the print head 24 and a timing disk 46, which reports the electronic control of the respective position of the print head 24, is connected with the shaft 45 of the motor 39. The timing disk 46 cooperates with a light barrier (not shown) and reciprocal movement of the print head 24 is achieved by means of reversing the rotational movement of the direct current motor 39.

An arbor or gudgeon 48 is arranged to engage with a driver roller 75 of the color band cartridge 5 and thereby operates to drive the color band 20. The arbor 48 is driven by a reducing gear unit 47 which also includes a one-way coupling (FIG. 2). The one-way coupling in the gear unit 47 ensures that the color band is driven only during rearward movement of the print head 24 when the parts 26 and 27 are in their raised or nonworking position shown in FIG. 3A.

The cartridge 5 may be inserted in operative engagement in the housing through the slot 4 and it is connected with its drive means including the arbor 48 and is made to engage so as to catch with the holding and displacing means. The cartridge has a recess 49 (FIG. 5) at its rightmost border in which a guide shoulder 50 at the printer frame 51 engages. The cartridge is provided with slots 76 at both sides into which there may enter resilient stop levers 52 having a projection 53. For the sake of clarity, only the leftmost stop lever 52 is shown in the drawings. The resilient stop lever 52 is supported on an axle 54 as seen in FIG. 1, and a bolt 55 at the resilient stop lever 52 cooperates with a guide 56 which consists of a disk 57 having three stop slots 58 arranged at an angle of 120° relative to each other. A curved groove 59 is formed in the disk 57 and the disk 57 is supported on a shaft 60. When the disk 57 rotates on the shaft 60, the bolt 55 moves within the groove 59 in such a manner that the stop lever 52 is pivoted, specifically in three different positions corresponding to the three color components 21, 22 and 23 of the color band 20.

In the position shown in FIG. 1, a stop spring 61 is engaged with its projection 62 with the stop slots 58 of the disk 57. In the position shown, the cartridge 5 is located at its rearmost retracted position. If the disk 57 is rotated in the clockwise direction through 120° so that the next stop slot 58 will engage with the projection 62 at the stop spring 61, then the stop lever 52 is swiveled in the clockwise direction as seen in FIG. 1 by means of the curved groove 59 and the bolt 55, whereby the next color zone 22 of the color band 20 will come into the working position. If the disk 57 is again rotated by 120° so that the third stop slot 58 in the disk 57 cooperates with the projection 62 at the spring 61, then the stop lever 52 is pivoted still further to the right in the clockwise direction so that the third color zone 21 of the color band 20 will be in the working position. During the next lifting movement of the disk 57, a rearward movement of the stop lever 52 into the work position is effected and controlled by means of the curved groove 59.

By means of the shaft 60, the disk 57 is connected with a belt roller 63 by means of which the drive belt 64 is guided. This drive belt 64 is resiliently fastened at drive lever 65 which is pivotally supported on a carrying bolt 67 by means of two bent ends 66. The drive lever 65 is actuated by means of a bolt 68 fastened on the carrying part 26 of the print head 24. For this purpose, the driver lever is provided with a slanted edge 69 by means of which it is supported at the bolt 68. The drive lever 65 is therefore pivoted during movement of the print head 24 from right to left and it transmits its drive movement to the roller 63 by means of the belt 64 and accordingly to the disk 57. The drive movement is terminated as soon as the bolt 68 slides over an end 70 of the edge 69 so that further drive movement is no longer transmitted. The bolt 68 does not engage with the edge 69 when the print head 24 moves from left to right because the print head is in its lowered position during this movement.

In the operation of the apparatus of the invention, the recording carrier 36, which is preferably ordinary paper, is laid upon the guide table 3 and inserted through the insertion channel 10 until it strikes against the drive and contact pressure rollers 13–16. The rollers are set in motion and operate to advance the recording carrier so that it passes between the print head 24, which is in its upwardly swiveled position shown in FIG. 3, and the printing beam 32. It should be noted that the scraper 34 rests with its front projection 35 on the upper guide member 8 as seen in FIG. 3A and comes to rest between the color band 20 and the recording carrier 36 which is supported on the printing beam 32.

As will be seen particularly from FIG. 4, the recording carrier 36 then strikes against a paper insertion sheet metal deflector 71 which, in its normal position, is in the position shown in dashed lines in FIG. 4. The deflector 71 is actuated by means of a weight 72 so as to deflect the recording carrier 36 into a rear guide duct 73 of the printer. The guide member 71 then swivels back to the position shown in solid line form in FIG. 5 whereby the deflector 71 operates to ensure that the recording carrier 36 will be lightly pressed downwardly during the printing process.

When the recording carrier 36 has reached its first line position, the printer is put into operation by means of an electronic control and the motor 39 starts to move the print head in a reciprocal fashion, wherein during each movement of the print head 24 from left to right, a color zone of the color band 20 is made to contact the recording carrier 36.

On the other hand, during movement of the print head 24 from right to left, the print head 24 is swiveled by means of the swivel lever 37 and the stop 38 so that it is not in contact with the color band or with the recording carrier whereby the print head 24 is then in the paper insertion position. During this movement, however, the guide 56 is, as already mentioned, simultaneously moved by means of the drive lever 65 in such a way that the color band 20 is brought into a working connection with another color zone for the next print run of the print head 24. A line is printed in color after three print runs of the print head from left to right.

The recording carrier can then be advanced by one line by means of the motor 17 and the gear unit 18, 19 so that a new line may be printed again in three print runs with respect to the color band 20.

Figure 6:
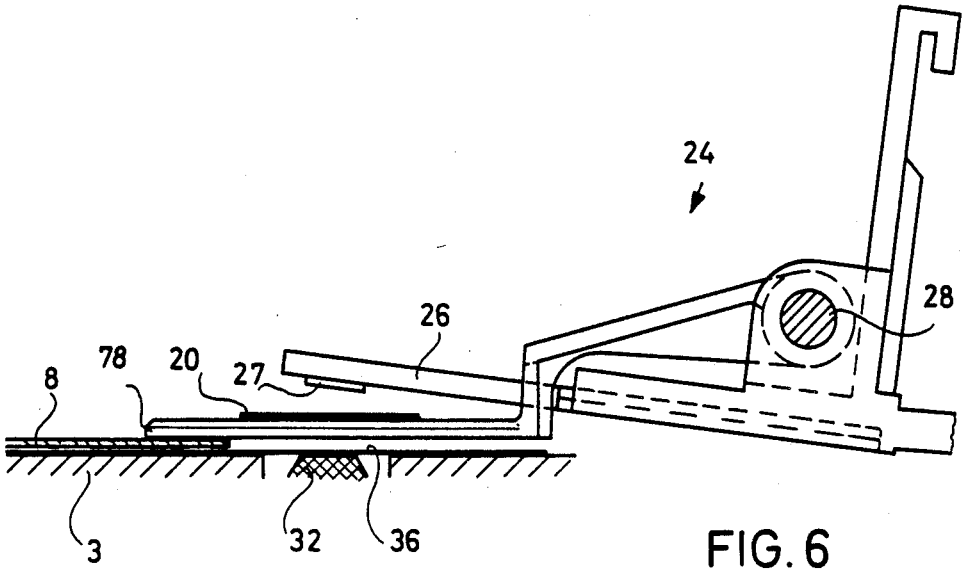
FIG. 6 is a detailed sectional view of parts of the apparatus similar to those depicted in FIGS. 3 and 3A.
Figure 6A:
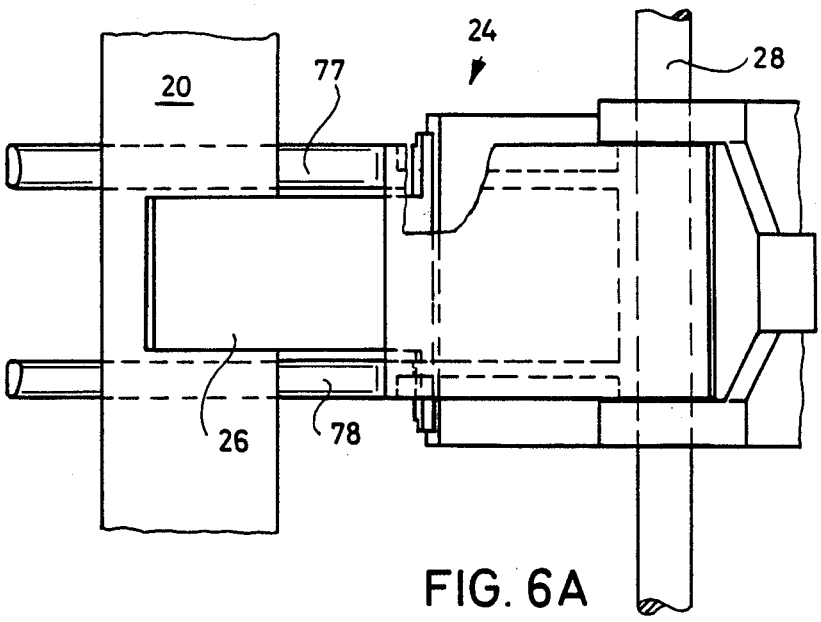
FIG. 6A is a top view of the parts depicted in FIG. 6.

FIGS. 6 and 6A show a side view and a top view, respectively, of the printing carriage, the scraper and the print counter support. In contrast to the representation shown in accordance with FIGS. 1 and 4, the scraper is not a resilient part, but a plastic member 77 which is loosely supported on the shaft 28 and which rests on the guide member 8 due to its weight. In FIG. 6, it may be seen that the print head 24 is in its paper insertion position.

In accordance with FIG. 6A, a scraper 77 and 78 is arranged at both sides of the print head 24. In the embodiment of the invention in accordance with FIGS. 1 and 2, printing is carried out when the print head 24 moves from left to right, that is, the print head is located in its work position while the return of the print head into the paper insertion position is effected with the print head in its raised position as shown in FIGS. 3 and 6A.

However, should printing be carried out also in the return run of the print head 24, then two scrapers 77 and 78 are necessary, one of which is active in the forward running position, while the other is active in the return run. In the two end positions, the movement of the print head 24 is effected into the paper insertion position while the scrapers 77 and 78 remain in their position according to FIGS. 3A and 6.

It is also essential that the color band 20 run through a print zone z, which is seen in FIG. 5 in a tensioned manner. The band 20 is drawn off from a supply reel 79 and is wound on a takeup reel 80. The drive is effected by means of the drive roller 75 within which the arbor 48 engages and effects the drive of the color band 20. The supply reel 79 of the color band is connected in an interlocked manner with the takeup reel 80 by means of a belt wheel 81 and a belt 83 which is also longitudinally elastic and by means of a belt wheel 84. The supply reel 79 is connected with the belt wheel 81 by means of a frictional connection. If the color band 20 is stretched or pulled out in an extended manner in the print zone z, e.g., by means of the print head 24, then tension is produced in the longitudinally elastic belt 83 which, when the print head 24 goes into its position shown in FIG. 3A, ensures that the color band is tensioned again, that is, on the shortest distance through the print zone. Between the color band 20 and the print zone and the housing wall 86 of the cartridge 5, there is consequently always sufficient room during insertion of the color band for the print head 24 to pass through while the scraper automatically remains in its correct position.

Accordingly, from the foregoing, it will be seen that the present is directed to printing apparatus having a coloring system or arrangement for the printer and particularly for a color transfer printer. With these printers, since a problem arises in that the color transfer band 20 adheres to the recording carrier 36 after printing, it is necessary that there be provided means for separating the transfer band 20 from the recording carrier 36. In the present invention, the scraper means previously described operates to perform its function and the invention is arranged so that the print head 24 may swivel between a work position and a paper insertion position. The scraper means 33, 34, 35, 77, 78 is connected with the print head 24 in such a way that its position does not change when the print head swivels. The scraper is supported at a stationary part 8 in front of the printing base 32 and does not join in the swiveling movement of the print head 24. It is particularly advantageous that the color transfer band 20 be arranged in a cartridge 5 and that the band 20 is run through the print zone z in a tensioned condition. In this case, the print head 24 can easily enter between the color band 20 and the cartridge housing 86 when the cartridge is introduced, while the scraper is arranged or positioned outside the band 20 and the recording carrier 36.

While specific embodiments of the invention have been shown and described in detail to illustrate the application of the inventive principles, it will be understood that the invention may be embodied otherwise without departing from such principles.

What is claimed is:

1. Printing apparatus including a coloring system comprising:

means defining a printing base;

a recording medium and a color transfer band superimposed over said recording medium on said printing base;

means for moving said recording medium and said color transfer band;

thermal printing head means movable through a linear path over said printing base for effecting printing upon said recording medium;

said printing head means being pivotable at locations along said linear path between a work position pressing said color transfer band and said recording medium together against said printing base and an open position lifted from said printing base to enable insertion of unprinted portions of said recording medium between said printing head means and said printing base;

scraper means mounted for movement together with said printing head means along said linear path and positioned between said color transfer band and said recording medium, said scraper means trailing behind said printing head means along said linear printing path for separating said recording medium and said color transfer band after a printing operation; and as guide member juxtaposed with said printing base to guide said recording medium for movement therebetween;

said scraper means being mounted to be resiliently pressed on said guide member and to be maintained between said recording medium and said color transfer band adjacent said print head means while said print head is pressed on said color transfer band against said printing base by pivotal motion thereof to said work position;

said printing head means being pivoted relative to said scraper means during movement to said open position of said printing head means whereby said scraper means is held to be maintained between said color transfer band and said recording means.

2. Apparatus according to claim 1 including means for shifting said color transfer band transversely relative to said linear path to bring different color zones on said color transfer band to a printing position relative to said print head means.

3. Apparatus according to claim 1, wherein said scraper means comprises resilient material and is maintained resiliently pressed against said guide member.

4. Apparatus according to claim 1, wherein said color transfer band comprises a thermotransfer color band.

5. Apparatus according to claim 4, wherein said thermotransfer color band is arranged in a cartridge in such a manner that the thermotransfer color band is drawn off from a supply reel and is wound on a takeup reel, with said band being arranged to pass through a printing zone between said printing head means and said printing base at the lower side of said cartridge through which said band is arranged to run in a tensioned condition.

6. Apparatus according to claim 5, wherein said cartridge is mounted to be shifted so as to move said band transversely relative to said linear path of said printing head means.

7. Apparatus according to claim 1, wherein said scraper means includes two scraper parts, each located on opposite sides of said printing head means taken in the direction of movement along said linear path.

* * * * *